US006598681B1

(12) United States Patent
Berry

(10) Patent No.: US 6,598,681 B1
(45) Date of Patent: Jul. 29, 2003

(54) DUAL GEARBOX ELECTRIC SUBMERSIBLE PUMP ASSEMBLY

(75) Inventor: Michael R. Berry, Norman, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 38 days.

(21) Appl. No.: 09/929,952

(22) Filed: Aug. 15, 2001

Related U.S. Application Data

(60) Provisional application No. 60/293,585, filed on May 25, 2001.

(51) Int. Cl.[7] ..... E21B 47/14

(52) U.S. Cl. ..... 166/369; 166/62; 166/105; 417/3

(58) Field of Search ..... 166/369, 62, 68, 166/68.5, 105, 106; 417/3, 410.1

(56) References Cited

U.S. PATENT DOCUMENTS 4,406,597 A * 9/1983 Stanton ..... 417/399
5,118,258 A * 6/1992 Martin ..... 417/3
5,497,832 A 3/1996 Stuebinger et al.
5,501,580 A 3/1996 Barrus et al.
5,722,820 A 3/1998 Wild et al.
5,820,354 A 10/1998 Wild et al.
5,902,378 A 5/1999 Obrejanu
5,988,992 A 11/1999 Tetzlaff et al.
6,045,333 A 4/2000 Breit
6,079,491 A 6/2000 Stuebinger et al.
6,123,149 A 9/2000 McKinzie et al.
6,170,572 B1 1/2001 Fulbright et al.
6,206,093 B1 * 3/2001 Lee et al. ..... 166/60
6,454,010 B1 * 9/2002 Thomas et al. ..... 166/369

* cited by examiner

*Primary Examiner*—William Neuder
(74) *Attorney, Agent, or Firm*—Crowe & Dunlevy, P.C.

(57) ABSTRACT

The present invention provides a electric submersible pump assembly for producing a fluid from a production zone to the surface and operated independently by one or more electric submersible motors using a dual or multiple gearbox, the electric submersible pump assembly including an inlet pump having a section head into which fluid enters from the production zone to the inlet pump, an outlet pump having an intake section communicating with the inlet pump so that fluid received therefrom is discharged through the outlet pump, an electric submersible motor, a first motor interface that connects the electric submersible motor to the inlet pump, and a second motor interface that connects the electric submersible motor to the outlet pump; each motor interface having a gearbox that connects to the electric submersible motor, a pump shaft connector that connects to the pump, and a seal section that joins the pump shaft connector to the gearbox.

21 Claims, 5 Drawing Sheets

DUAL GEARBOX ELECTRIC SUBMERSIBLE PUMP ASSEMBLY

RELATED APPLICATIONS

This application claims priority to Provisional Application Ser. No. 60/293,585 entitled "DUAL GEARBOX ELECTRIC SUBMERSIBLE PUMP ASSEMBLY" filed May 25, 2001.

FIELD OF INVENTION

The present invention relates to the field of electric submersible pump assemblies and associated support equipment, and more particularly but not by way of limitation, to a dual gearbox electric submersible pump assembly utilized with various pumps including progressive cavity pumps.

BACKGROUND OF INVENTION

In oil wells and the like from which the production of fluids is desired, a variety of fluid lifting systems have been used to pump the fluids to surface holding and processing facilities. It is common to employ various types of downhole pumping systems to pump the subterranean formation fluids to surface collection equipment for transport to processing locations.

One such prior art pumping system is a submersible pumping assembly which is supported in the wellbore, the submersible pumping assembly having a pump and a motor to drive the pump to pressurize and pass the fluid through production tubing to a surface location. A typical electric submersible pump assembly includes a submersible pump and an electric motor with a gearbox. The purpose of the gearbox is to allow the motor to operate under different loads by controlling the torque.

Prior art gearboxes have not proved effective in handling the requirements of many pumps including the progressive cavity pump (PCP). Thus, there is a need for a gearbox capable of effectively controlling various pumps including progressive cavity pumps in applications that are currently limited by the torque capacity of the reduction gearbox.

SUMMARY OF THE INVENTION

The present invention provides an electric submersible pump assembly for producing fluid from a production zone to a surface. The electric submersible pump assembly includes an electric submersible motor, a progressive cavity pump and a second pump. The progressive cavity pump is disposed above a lower packer and includes a section head and intake tubing to receive the fluid from the production zone. The second pump is disposed below an upper packer and includes production tubing and an intake section to receive the fluid from the progressive cavity pump. A first motor interface connects the electric submersible motor to the progressive cavity pump and a second motor interface connects the electric submersible motor to the second pump. The first and second motor interfaces include a gearbox, a flex shaft and a seal section.

The electric submersible pump assembly includes an inlet pump having a section head such that the fluid enters from the production zone through the inlet pump, an outlet pump having an intake section such that the fluid enters from the inlet pump and is discharged through the outlet pump, an electric submersible motor, a first motor interface that connects the electric submersible motor to the inlet pump, and a second motor interface that connects the electric submersible motor to the outlet pump; each motor interface having a gearbox that connects to the electric submersible motor, a pump shaft connector that connects to the pump, and a seal section that joins the pump shaft connector to the gearbox.

The advantages, features and benefits of the present invention will become clear from the following detailed description and drawings when read in conjunction with the appended claims.

DESCRIPTION

Figure 1:
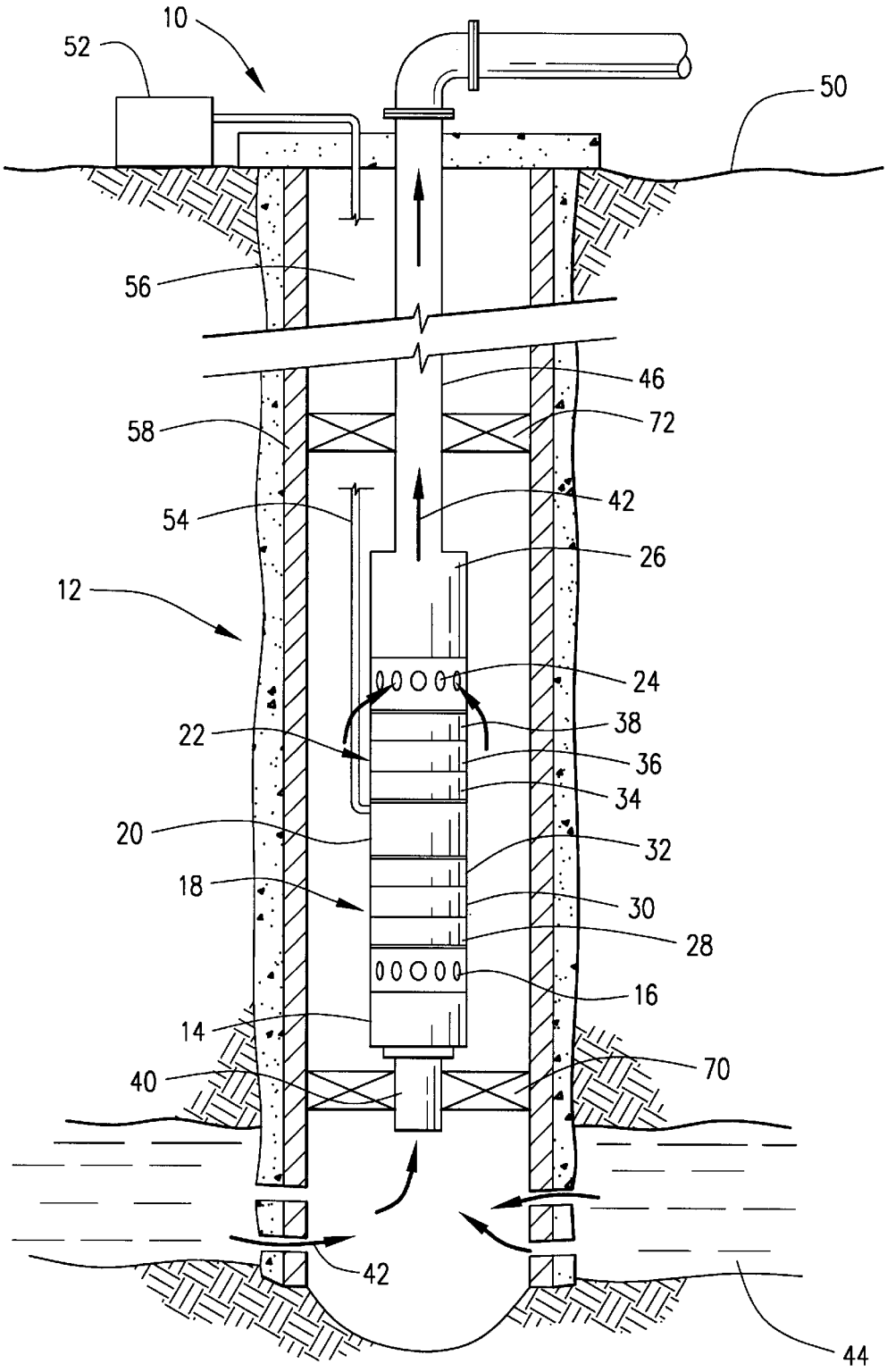
FIG. 1 is a diagrammatical, elevational semi-detailed view of an electric submersible pump (ESP) assembly constructed in accordance with the present invention and supported in a wellbore.

Referring to the drawings in general and particularly to FIG. 1, shown therein is a wellbore 10 containing an electric submersible pump assembly 12, also called herein the ESP assembly 12, shown disposed in the wellbore 10. It will be understood that numerous valves, safety devices and other equipment typically used in such installations are omitted herein as such are unnecessary for the description of the present invention. While the present invention will be described in relation to the ESP assemblies shown in the appended drawings, it will be understood that the present invention can be adapted to other embodiments.

The ESP assembly 12 has, from bottom to top, an inlet pump 14, a section head 16 (similar to those associated with an ESP intake section), a first motor interface 18, an electric submersible motor 20, a second motor interface 22, an intake section 24, and a outlet pump 26. The first motor interface 18 includes a first flex-shaft 28 (also referred herein as a pump shaft connector), a first seal section 30, and a first gearbox 32. The second motor interface 22 includes a second gearbox 34, a second seal section 36, and a second flex-shaft 38. The ESP assembly 12 is particularly well suited to be used in conjunction with rotary or shaft-driven pumps, preferably a progressive cavity (PC) pump, that can operate independently of other pumps while being powered by the one electric submersible motor 20.

Intake tubing 40 allows a produced fluid stream 42 from a reservoir 44, also known as a production zone, to enter the inlet pump 14 which is in fluid communication with the outlet pump 26. After the produced fluid 42 passes through the outlet pump 26, the produced fluid 42 is pumped through production tubing 46 to a surface 50. The electric submersible motor 20 can be controlled at the surface by a variable speed device (VSD) 52 via a cable 54 that is run beside the production tubing 46 in an annulus 56. As one skilled in the art would be aware, a packer can support and centralize casing 58 and be used to protect the casing 58.

Figure 2:
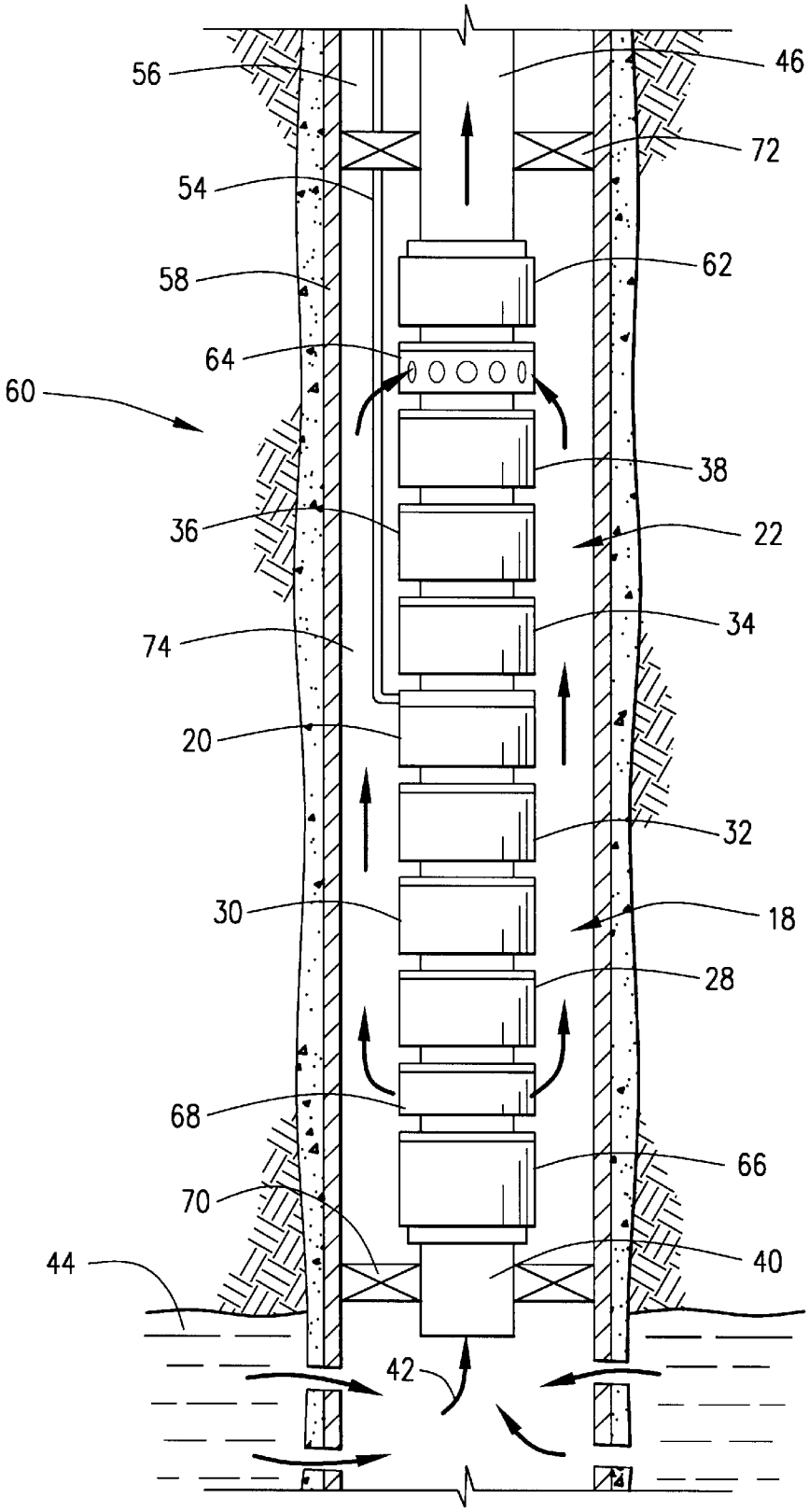
FIG. 2 is a diagrammatical, elevational view of an embodiment of the ESP assembly of FIG. 1.

FIG. 2 shows an ESP assembly that operates with a progressive cavity pump, herein referred to as an ESP-PCP assembly 60. The ESP-PCP assembly 60 includes a PC outlet pump 62 with an intake section 64 and a PC inlet pump 66 with a section head 68 that has an opening not shown. A fluid stream, also known as flow stream 42 from the production zone 44 enters the PC inlet pump 66 which is in fluid communication with the PC outlet pump 62. The first motor interface 18 and the second motor interface 22 transfer rotary motion from the electric submersible motor 20 to both the PC outlet pump 62 and the PC inlet pump 66. The motor interfaces 18, 22 include the flex-shafts 28, 38; the seal sections 30, 36; and the gearboxes 32, 34, as discussed above. The flex-shafts 28, 38 are capable of transmitting torque from the electric submersible motor 20 to either one or both of the PC pumps 62, 66. A first packer 70 and a second packer 72 are used to create an annular channel 74 that allows the PC inlet pump 66 to be in fluid communication with the PC outlet pump 62.

Figure 3:
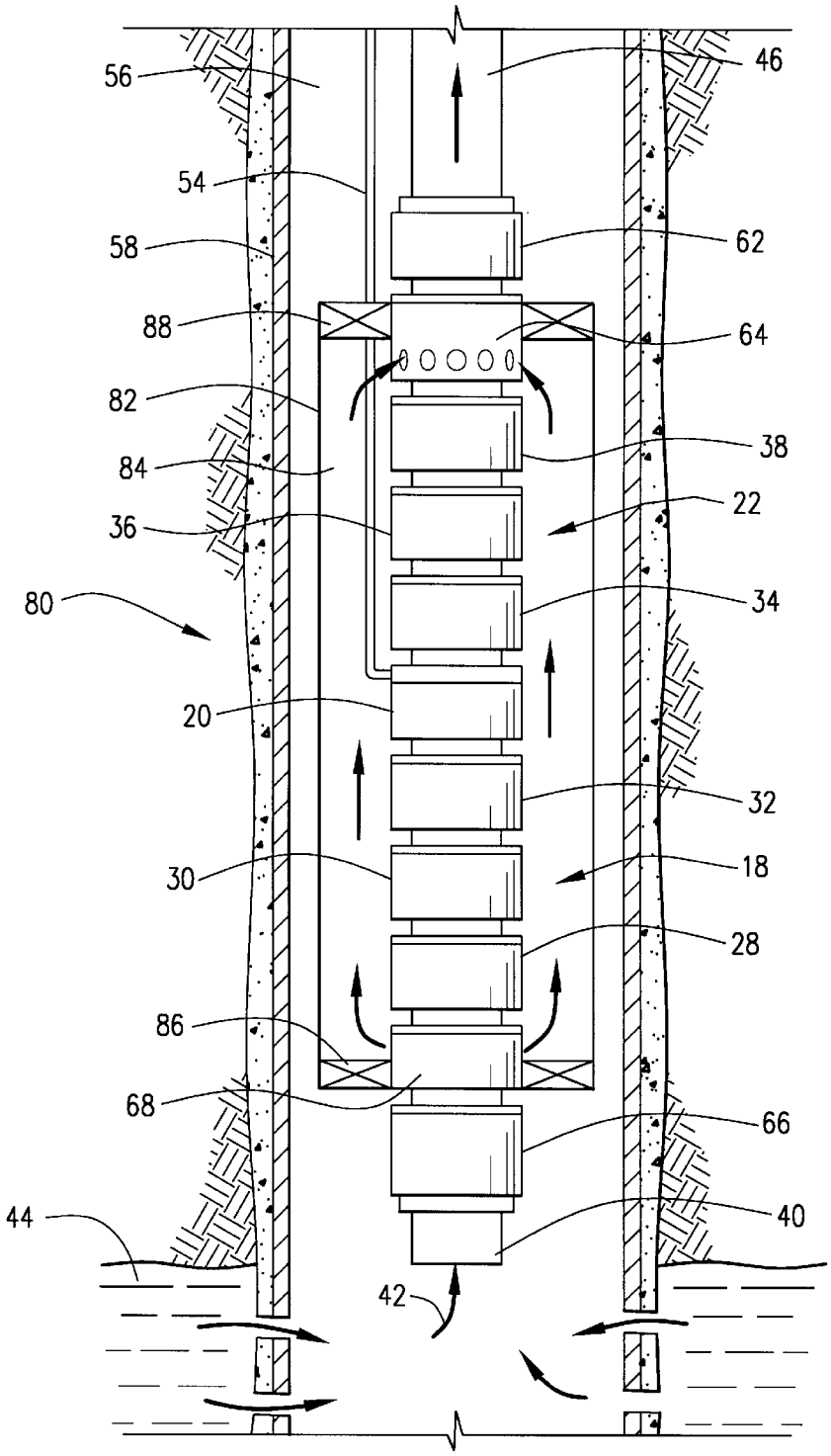
FIG. 3 is a diagrammatical, elevational view of another embodiment of an ESP assembly, with a shroud, constructed in accordance with the present invention.

FIG. 3 shows an ESP-PCP assembly 80 that has a shroud 82. The shroud 82 provides an alternative fluid channel 84 between a shroud base 86 and a shroud top 88. As in the ESP-PCP assembly 60, the ESP-PCP 80 uses the electric submersible motor 20 to power rotary or shaft-driven pumps, preferably progressive cavity pumps. The flow stream 42 from the production zone 44 enters the PC inlet pump 66, with section head 68 that has an opening not shown, which is in fluid communication with the PC outlet pump 62 through the flow channel 84. The first motor interface 18 and the second motor interface 22 transfer rotary motion to either one or both of the PC outlet pump 62 and the PC inlet pump 66.

Figure 4:
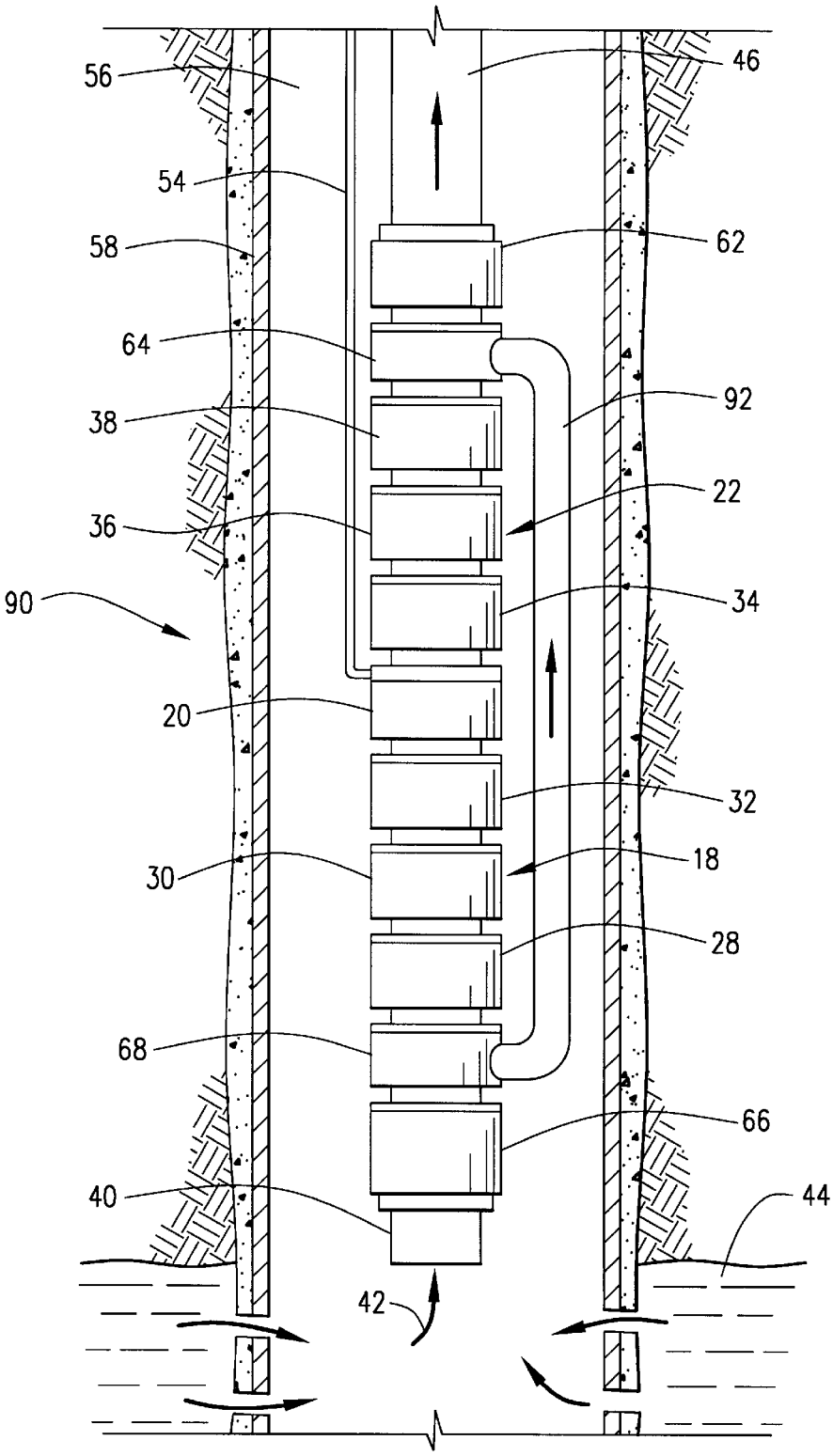
FIG. 4 is a diagrammatical, elevational view of another embodiment of an ESP assembly with a bypass tubing, constructed in accordance with the present invention.

FIG. 4 shows an ESP-PCP assembly 90 that allows fluid communication between the PC inlet pump 66, with the section head 68, and the PC outlet pump 62, with the intake section 64, through a bypass tube 92. As in the ESP-PCP assembly 60 described above, the ESP-PCP assembly 90 uses the electric submersible motor 20 to power rotary or shaft-driven pumps, preferably a progressive cavity pumps. The flow stream 42 from the production zone 44 enters the PC inlet pump 66 which is in fluid communication with the PC outlet pump 62 through the bypass tube 92. The first motor interface 18 and the second motor interface 22 transfer rotary motion to either one or both of the PC inlet pump 66 and the PC outlet pump 62.

Figure 5:
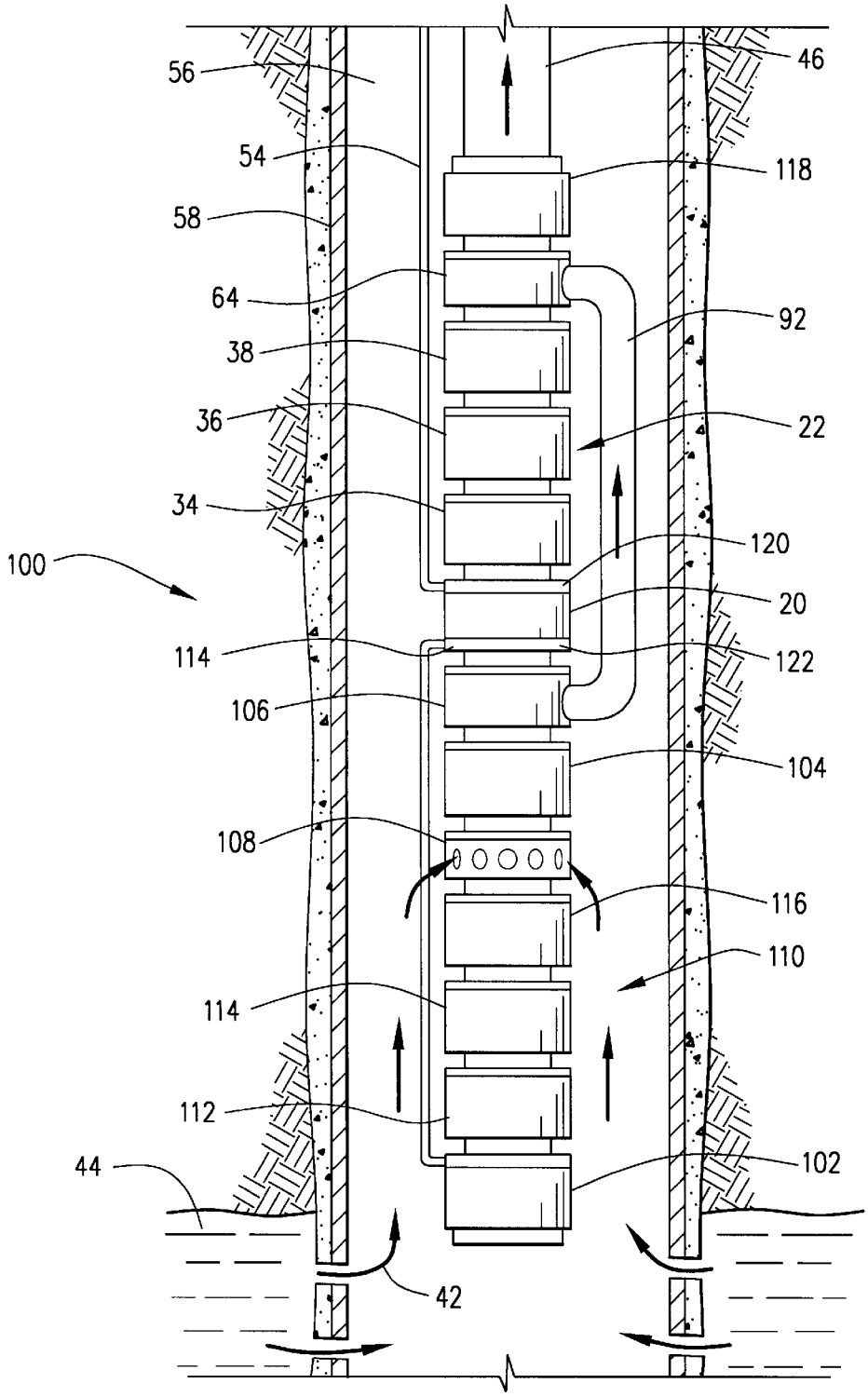
FIG. 5 is a diagrammatical, elevational view of another embodiment of an ESP assembly, with a bypass tubing and an additional motor, constructed in accordance with the present invention.

FIG. 5 shows an ESP assembly 100 that has a second electric submersible motor 102 and an alternate PC pump 104. This alternate PC pump 104 has both a discharge section, also known as an alternate section head 106, and an alternate intake section 108. The arrangement of components is different from those in the above discussed ESP-PCP assembly 60. The ESP assembly 100 has, from bottom to top, the second electric submersible motor 102 and an alternate motor interface 110 which includes an alternate seal section 112, an alternate gearbox 114 and an alternate flex-shaft 116 (as shown in FIG. 5), the alternate intake section 108 below the alternate PC pump 104, and the alternate section head 106.

Above the alternate section head 106 is the electric submersible motor 20, the second motor interface 22, the intake section 64, and an outlet pump 118. The second motor interface 22 includes the second gearbox 34, the second seal section 36, and the second flex-shaft 38, as discussed above. A single power cable can be used to power both electric submersible motors 20, 102 by connecting the electric submersible motor 20 with a first section head 120 (also known as a pothead base) and a second section head 122, as is shown in FIG. 5, to the second electric submersible motor 102. This is accomplished by placing the first section head 120 in a conventional location on the upper side of the electric submersible motor 20 in power communication with the electric cable 54. The second section head 122 is placed upside down on the lower side of the electric submersible motor 20 in power communication with the first section head 120 and the second electric submersible motor 102 which in turn is in mechanical communication with the alternate pump 104.

The ESP assembly 100 uses the bypass tube 92 to allow fluid communication between the alternate PC pump 104 and the outlet pump 118. Other arrangements, such as the use of two packers or a shroud, could be substituted for the bypass tube 92. The outlet pump 118 can be any type of pump, such as a centrifugal pump, that will allow maximum efficiency in specific production situations, as will be discussed in more detail below.

In operation, the intake tubing string 40, shown in FIG. 2, can include a tubing packer or a seal section to sting into a packer seal bore (not shown) located above the completion interval. The fluid stream 42 enters the lower or PC inlet pump 66 and is discharged into the annular channel 74. The flow stream 42 is forced to move up the annular channel 74. The flow stream 42 is forced into the pump intake section 64 because of the upper or second packer 72. Finally the fluid stream enters the PC outlet pump 62 and is pumped to the surface 50.

In the ESP-PCP assembly 80 and ESP-PCP assembly 90 shown in FIGS. 3 and 4, the shroud 82, and the bypass tube 92 eliminates the need for packers 70, 72. In the ESP-PCP assembly 80 (see FIG. 3) and ESP-PCP assembly 90 (see FIG. 4) any free gas can proceed up the annulus 56. Gas separation can be enhanced by either extending the intake tubing 40 below the production zone 44 or incorporating a reverse shroud on the intake tubing 40. In the embodiment, shown in FIG. 5, the second electric submersible motor 102 is shown to work in conjunction with the bypass tube 92. This embodiment would also work well with a shroud or with packers, as discussed above.

The present invention has been described with one or two motors but can be utilized with additional motors and additional motor interfaces and pumps. A single power cable can be used for multiple motors by connecting a center tandem motor(s) with a pothead base(s), as is shown in FIG. 5. For two motors this is accomplished by taking two section heads and placing the first section head 120 in a conventional location on the upper side of the electric submersible motor 20 so that it is in power communication with the power cable 54 and another section head, the second section head 122, which is placed upside down on the lower side of the motor. The second head 122 is placed to be in power communication with both the first section head 120 and the second electric submersible motor 102 which in turn powers the alternate pump 104. If there are more motors the same arrangement would be continued for the additional motors as one skilled in the art would understand.

If there is significant gas present in the fluid stream, it can be advantageous to use a tapered design and a smaller capacity PC outlet pump 62, or other known methods to handle the gas expansion. The present invention offers another advantage when there is a significant amount of gas present in the fluid stream. Although the rotary pumps discussed in the above ESP-pump assemblies were described as a PC pump, centrifugal pump or other downhole rotary pumps can also be incorporated. The present invention is very useful in combination with a centrifugal pump when an entire flow stream includes so much free gas that a single centrifugal pump cannot pump the fluid efficiently. The present invention's lower pump can be a pump that is capable of compressing the free gas, such as a PC pump, and the upper pump can be a pump without a gearbox, such as a centrifugal pump, that doesn't have a torque limit and is thus able to overcome a higher head (pressure due to a column of fluid) and can consequently lift the fluid stream to the surface. This combination of pumps can efficiently pump the total stream including the free gas. This is especially helpful when the lower pump is a pump capable of compressing gas and the upper pump is not torque limited and thus capable of pumping the fluid to the surface.

It is clear that the present invention is well adapted to carry out the objects and to attain the ends and advantages mentioned as well as those inherent therein. While presently preferred embodiments of the invention have been described in varying detail for purposes of the disclosure, it will be understood that numerous changes can be made which will readily suggest themselves to those skilled in the art and which are encompassed within the spirit of the invention disclosed in the above text and in the accompanying drawings.

I claim:

1. An electric submersible pump assembly for producing a fluid from a production zone to a surface, comprising:

a first pump having a section head into which fluid enters from the production zone to the first pump;

a second pump having an intake section communicating with the first pump so that the fluid is discharged through the second pump;

an electric submersible motor;

a first motor interface that connects the electric submersible motor to the first pump; and a second motor interface that connects the electric submersible motor to the second pump, each of the first and second motor interfaces comprising:

a gearbox connected to the electric submersible motor;

a pump shaft connector that is connected to the pump; and a seal section that joins the pump shaft connector to the gearbox.

2. The electric submersible pump assembly of claim 1 wherein the pump shaft connector is a flex shaft capable of transferring torque to the first pump and the second pump.

3. The electric submersible pump assembly of claim 2 wherein the first pump is a progressive cavity pump.

4. An electric submersible pump assembly for producing a fluid from a production zone to a surface, comprising:

an electric submersible motor:

a progressive cavity pump disposed above a lower packer and having a section head and intake tubing to receive the fluid from the production zone;

a second pump disposed below an upper packer and having production tubing and an intake section to receive the fluid from the progressive cavity pump;

a first motor interface that connects the electric submersible motor to the progressive cavity pump: and a second motor interface that connects the electric submersible motor to the second pump, each of the first and second motor interfaces comprising: a gearbox connected to the electric submersible motor; a flex shaft connected to the pump and to transfer torque to the pump; and a seal section that joins the flex shaft to the gearbox.

5. The electric submersible pump assembly of claim 4, further comprising bypass tubing in fluid communication with both the progressive cavity pump and the second pump such that the fluid first enters the first pump and is transported to the second pump via the bypass tubing before being pumped to the surface through the production tubing.

6. The electric submersible pump assembly of claim 4, further comprising a shroud that contains the motor, the first motor interface and the second motor interface such that the fluid first enters the progressive cavity pump and is transported to the second pump via the shroud before being pumped to the surface through the production tubing.

7. The electric submersible pump assembly of claim 4 wherein the progressive cavity pump is an alternate pump with both an alternate section head and an alternate intake section such that the fluid enters the alternate intake section and moves to the second pump via the alternate section head before being pumped to the surface through the production tubing.

8. The electric submersible pump assembly of claim 7 wherein an alternate motor interface is connected to the alternate intake section of the alternate pump and wherein a second motor is connected to the second motor interface such that the fluid enters the alternate pump, exits through the section head, and enters the second pump before being pumped to the surface through the production tubing, the alternate motor interface comprising:

a gearbox that connects to the electric submersible motor via a seal section; and a pump shaft connector that transfers torque between the alternate pump and the gearbox.

9. An electric submersible pump assembly for producing a fluid from a production zone to a surface, comprising:

a first pump having a section head such that the fluid enters from the production zone through the first pump;

a second pump having an intake section such that the fluid enters from the first pump and is discharged through the second pump; and an encapsulated device in fluid communication with the surface comprising:

an electric submersible motor;

a first motor interface that connects the electric submersible motor to the first pump; and a second motor interface that connects the electric submersible motor to the second pump, each motor interface comprising:

gearbox that connects to the electric submersible motor;

a pump shaft connector that connects to the pump; and a seal section that joins the pump shaft connector to the gearbox.

10. The electric submersible pump assembly of claim 9 wherein the pump shaft connector is a flex shaft capable of transferring torque to the first pump and the second pump.

11. The electric submersible pump assembly of claim 10 wherein the first pump is a progressive cavity pump.

12. An electric submersible pump assembly for producing a fluid from a production zone to a surface, comprising:

a first rotary pump having a section head such that the fluid enters from the production zone through the first rotary pump;

a second rotary pump having an intake section such that the fluid enters from the first rotary pump and is discharged through the second pump;

an electric submersible motor;

a first motor interface that connects the electric submersible motor to the first pump; and a second motor interface that connects the electric submersible motor to the second rotary pump, each motor interface comprising:

a gearbox that connects to the electric submersible motor;

a pump shaft connector that connects to the rotary pump; and a seal section that joins the pump shaft connector to the gearbox.

13. The electric submersible pump assembly of claim 12 wherein the pump shaft connector is a flex shaft capable of transferring torque to the first rotary pump and the second rotary pump.

14. The electric submersible pump assembly of claim 13 wherein the rotary pump is a progressive cavity pump.

15. An electric submersible pump assembly for producing a fluid from a production zone to a surface comprising:

an electric submersible motor:

a first rotary pump disposed above a lower packer and having a section head and intake tubing to receive the fluid from the production zone:

a second rotary pump disposed below an upper packer and having production tubing and an intake section to receive the fluid from the first rotary pump;

a first motor interface that connects the electric submersible motor to the rotary pump, and a second motor interface that connects the electric submersible motor to the second pump, each of the first and second motor interfaces comprising: a gearbox connected to the electric submersible motor, a flex shaft connected to the pump and to transfer torque to the pump, and a seal section that joins the flex shaft to the gearbox.

16. The electric submersible pump assembly of claim 15, further comprising bypass tubing that is in fluid communication with both the first rotary pump and the second rotary pump such that the fluid first enters the first rotary pump and is transported to the second rotary pump via the bypass tubing before being pumped to the surface through the production tubing.

17. The electric submersible pump assembly of claim 15, further comprising a shroud that contains the motor, the first motor interface and the second motor interface such that the fluid first enters the first rotary pump and is transported to the second rotary pump via the shroud before being pumped to the surface through the production tubing.

18. The electric submersible pump assembly of claim 17 wherein the first rotary pump is an alternate rotary pump with both an alternate section head and an alternate intake section such that the fluid enters the alternate intake section and moves to the second rotary pump via the alternate section head before being pumped to the surface through the production tubing.

19. The electric submersible pump assembly of claim 18 wherein an alternate motor interface is connected to the alternate intake section of the alternate rotary pump and wherein a second motor is connected to the second motor interface such that the fluid enters the alternate rotary pump, exits through the section head, and enters the second rotary pump before being pumped to the surface through the production tubing, the alternate motor interface comprising:

a gearbox that connects to the electric submersible motor via a seal section; and a pump shaft connector that transfers torque between the pump and the gearbox.

20. A method for producing fluid from a production zone to a surface using an electric submersible pump assembly, the method comprising:

disposing into a wellbore the electric submersible pump assembly that includes a first pump, a second pump, and a motor that drives the first and second pump via first and second gearboxes pumping the fluid from the production zone toward the second pump using the first pump: and pumping the fluid to the surface using the second pump.

21. The method of claim 20, further comprising operating a first and second motor interface that connects to the first pump and second pump respectively, each motor interface comprising:

a pump shaft connector that connects to the pump; and a seal that joins the pump shaft connector to the gearbox.

* * * * *

UNITED STATES PATENT AND TRADEMARK OFFICE

CERTIFICATE OF CORRECTION

PATENT NO. : 6,598,681 B1
DATED : July 29, 2003
INVENTOR(S) : Michael R. Berry

It is certified that error appears in the above-identified patent and that said Letters Patent is hereby corrected as shown below:

Title page,
Item [57], ABSTRACT,
Line 1, replace “a electric” with -- an electric --.

Column 2,
Line 22, replace “assembly with” with -- assembly,with --.

Column 3,
Line 37, replace “a progressive cavity pumps” with -- progressive cavity pumps --.

Column 5,
Line 23, replace “I claim” with -- We claim --.

Signed and Sealed this

Third Day of February, 2004

JON W. DUDAS
*Acting Director of the United States Patent and Trademark Office*